United States Patent [19]

Houghton

[11] Patent Number: 4,718,355

[45] Date of Patent: Jan. 12, 1988

[54] VERTICALLY ADJUSTABLE PATIENT SUPPORT TABLE

[76] Inventor: George W. Houghton, 532 Holland Ave., Cayce, S.C. 29033

[21] Appl. No.: 826,018

[22] Filed: Feb. 4, 1986

[51] Int. Cl.[4] ..... A47B 9/00

[52] U.S. Cl. ..... 108/147; 108/144

[58] Field of Search ..... 108/147, 145, 144, 106; 248/404

[56] References Cited

U.S. PATENT DOCUMENTS

| | | | |
|---|---|---|---|
| 1,725,216 | 8/1929 | Seldomridge | 108/147 X |
| 2,587,094 | 2/1952 | Berg et al. | 108/147 X |
| 3,237,921 | 3/1966 | Jay | 108/147 X |
| 3,305,876 | 2/1967 | Hutt | 108/147 X |
| 4,148,264 | 4/1979 | Caravias | 108/145 |
| 4,232,901 | 11/1980 | Harrington et al. | 108/147 X |
| 4,511,110 | 4/1985 | Möller | 108/147 X |
| 4,515,087 | 5/1985 | Kurrasch | 108/147 |

FOREIGN PATENT DOCUMENTS

| | | | |
|---|---|---|---|
| 1161395 | 1/1964 | Fed. Rep. of Germany | 108/145 |
| 1909471 | 5/1971 | Fed. Rep. of Germany | 108/147 |
| 2530956 | 1/1977 | Fed. Rep. of Germany | 108/147 |
| 259392 | 1/1949 | Switzerland | 108/145 X |
| 478543 | 11/1969 | Switzerland | 108/147 |

*Primary Examiner*—Kenneth J. Dorner
*Assistant Examiner*—José V. Chen
*Attorney, Agent, or Firm*—John P. Snyder

[57] ABSTRACT

A patient support platform is provided with compound leg structure which allows the platform to move to a squatted position giving easy access for a patient or to disposition of a patient thereon and, at the same time, the platform is adjustable to elevated positions so that a standing attendant may administer to the patient. Supporting feet are disposed in a fixed, predetermined pattern and provide pivot points to which the compound leg structures are pivoted. The compound leg structures effect raising and lowering of the platform without changing or disturbing the positions of the feet.

10 Claims, 7 Drawing Figures

FIG. 1
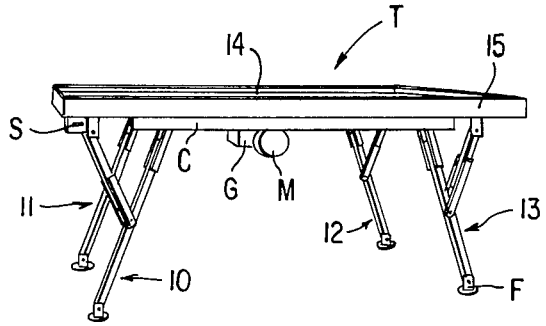
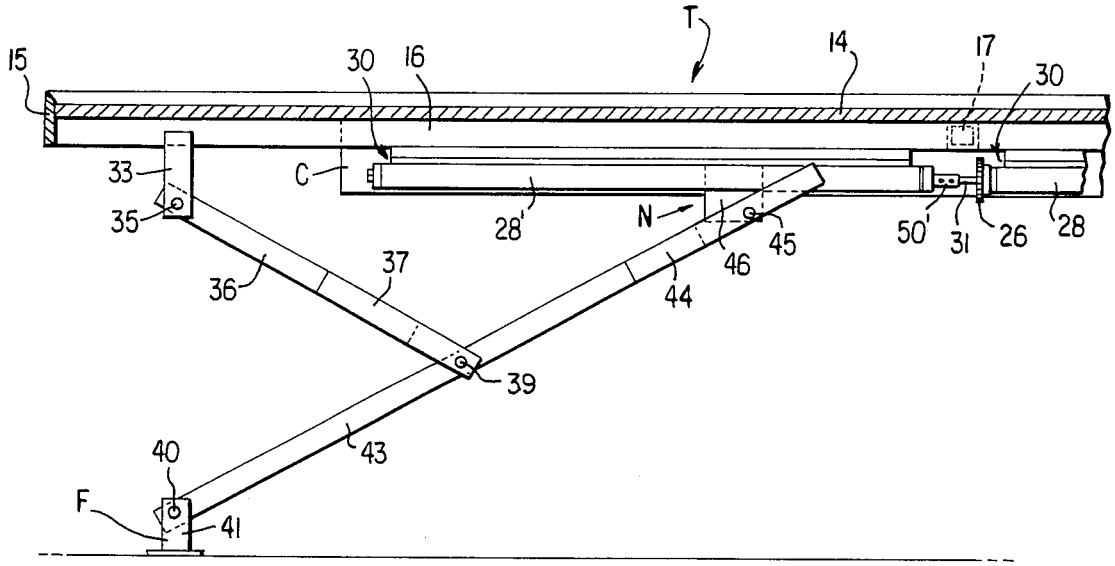
FIG. 2
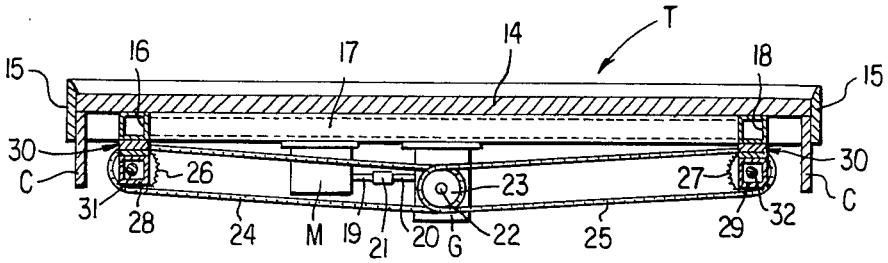
FIG. 3

FIG. 4
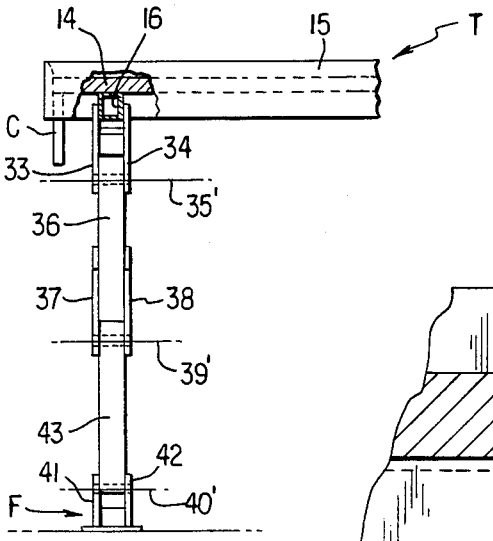
FIG. 5
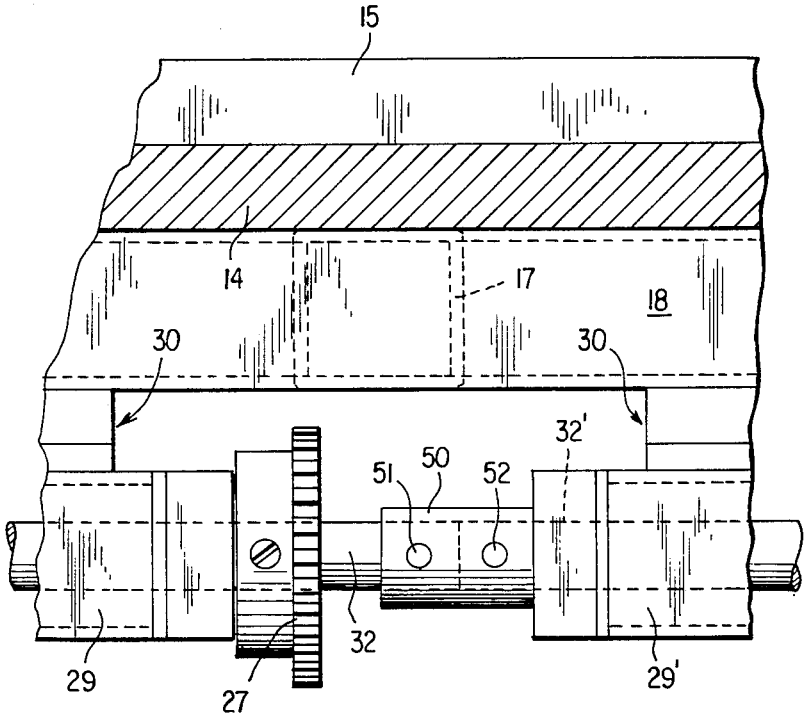
FIG. 6
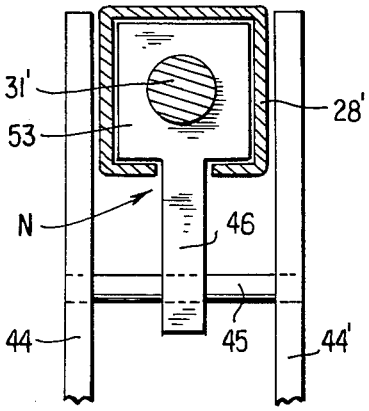
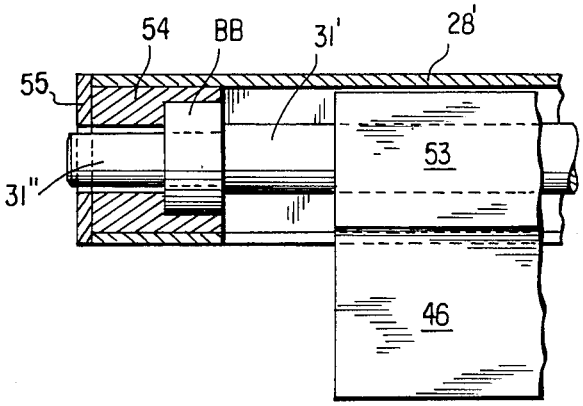
FIG. 7

VERTICALLY ADJUSTABLE PATIENT SUPPORT TABLE

BACKGROUND AND SUMMARY OF THE INVENTION

The present invention is directed to supporting tables or platforms particularly adapted to support a patient or the like in recumbent position and in which supporting leg mechanism is incorporated to allow the supporting table or platform to squat to a lowered position upon which a person, particularly a handicapped person seated in a wheelchair, may easily position himself or be positioned and thereafter be elevated to a position for treatment, examination or the like.

Typically, the supporting table may squat to a position in which the supporting surface thereof is elevated not more than about a foot above the floor or other like base surface, and is thereafter capable of being elevated to a maximum height of, say, thirty six inches above the floor. This capability allows substantial ease, comfort and safety in accommodating the person with whom the table is to be used. For example, the table may initially be adjusted in height to whatever lowered elevation is easiest, safest and most comfortable for transfer of the person to a supported position upon the table. Then, the person while recumbent or in the desired position may readily be elevated to that position required. The leg structure and raising/lowering mechanism provides an extremely steady and firm support in any position of the table even if the table is unevenly loaded as by a person sitting at one side thereof, is resistant to tipping or overturning in any vertical position, and is free from extraneous movements while being raised or lowered.

A benificial feature of the invention is the capability for allowing the table to squat to an extremely low postion when this is necessary or desirable without any interference or contact with the underlying surface. Thus, the drive mechanism for operating the table vertically is compactly mounted beneath the table or platform and, as well, the supporting leg structures are widely stanced and fully supportive in any vertical position of the platform. Further, the feet for the supporting legs are disposed in fixed postions relative to each other and remain so while vertical adjustments are being made. Moreover, the individual leg structures at their attachment points to the table partake of smooth, coordinated and uniform movements during raising and lowering operations.

An important aspect of the invention resides in the utilization of an H-shaped main frame assembly underlying the platform and which serves not only to support and attach to the platform or table but also serves to mount the four supporting leg structures and the associated drive mechanisms in suspended relation thereto. The drive mechanisms incorporate lead-screw/nut drive assemblies which positively and firmly retain the platform in any elevated position thereof without danger of inadvertent downward movement. The uniform and coordinated movements of the leg structures, at the same time, assure that the platform is raised or lowered in level, steady fashion. Movable portions of the leg structures not only straddle opposite corresponding sides of the H-shaped main frame but also those associated portions of the lead-screw/ nut drive mechanisms suspended thereon, thus contributing to the ability of the assembly to squat to an extreme lowered position. The cross piece of the main frame serves to mount and suspend not only a driving motor but also a suitable drive reduction unit in compact, effective fashion so that the squat position leaves sufficient clearance space beneath these units. This arrangement also allows a chain drive to be utilized from the reduction unit to the lead-screw/nut final drive units so that a smooth, noisless and effective drive arrangement is provided.

Other and further objects and advantages of this invention will become apparanent as this description proceeds.

BRIEF DESCRIPTION OF THE DRAWING FIGURES

FIG. 1 is a perspective view of an embodiment of the invention;

FIG. 2 is a longitudinal section through the assembly which illustrates the geometric layout and components of the leg structures employed in the invention;

FIG. 3 is a transverse section illustrating the arrangement of certain drive components and of the main frame;

FIG. 4 is an end elevational view, partly broken away, illustrating certain details common to all of the leg structures;

FIG. 5 is and enlarged partial section illustrating certain details of the lead-screw/ nut units and their drive input;

FIG. 6 is a transverse section through one of the lead-screw/nut units illustrating certain details thereof; and FIG. 7 a longitudinal view, partly in section, illustrating further details of a lead-screw/nut unit.

DETAILED DESCRIPTION OF THE INVENTION

With reference to FIG. 1 at this time, the supporting platform or table is indicated by the reference character T therein and is supported by the four leg assemblies indicated generally by the reference characters 10, 11, 12 and 13, each firmly supported on the underlying floor surface by a foot F. The electric drive motor M is illustrated to be in its suspended position as will later be described, as is the gear reduction unit G. The motor M is reversible and and electric switch for this purpose is indicated by the reference character S. The sides of the platform T are provided with the side plates or barriers 15 which extend slightly above the upper surface of the table T as illustrated. FIG. 1 also illustrates one of the two cosmetic side covers C which also serve to protect an operator or other individual against inadvertent contact with moving parts of the assembly during raising or lowering operations.

FIG. 3 details some of the underlying structure of the invention. Thus, the main frame will be seen to include the parallel opposite side frame members 16 and 18 rigidly connected by the cross piece 17 and to which the platform or table 14, preferably wooden, is securely attached. The main frame is preferably constructed from square, metal tubing stock having dimesions of, say, $1\frac{1}{2} \times 1\frac{1}{2}$ inches and of relatively substantial wall thickness. As will be seen, the motor M and the gear reduction unit G are mounted directly on the crosspiece 17 in suspended position therefrom. The motor M is mounted so that its output shaft 19 is generally parallel to the crosspiece 17 and is coupled through a suitable sleeve 21 to the input shaft 20 of the gear reduction unit G. The output shaft 22 of the reduction unit G is orthogonal relative to the input shaft 20 and mounts a dual sprocket assembly 23 over which the respective endless chain loops 24 and 25 are trained. The chain loop 24 is also trained over the sprocket 26 whereas the chain 25 is trained over the sprocket 27 and as will be explained in greater detail hereinafter, the sprocket 26 is mounted on a lead-screw 31 whereas the sprocket 27 is mounted on the lead-screw 32. The housings for two of the lead-screw units are indicated by the reference characters 28 and 29 and as will later appear, each of these units has an axially aligned counterpart 28' or 29'. Thus, there are four lead-screw units in all, one for and associated with each of the leg assemblies as later detailed.

It will be noted that the unit 28 directly underlies the frame member 16, is of square dimensions the same as the frame member 16 and is secured thereto in standoff relation below it by the spacer plates or strips indicated generally at 30. Similarly, the unit 29 is dimensioned as aforesaid relative to the frame member 18 which it underlies and is in standoff relation thereto by reason of the further spacer assembly 30 as shown. At this point, it is well to note that the direction of rotation of the motor M is selected by the previously mentioned switch S which is preferably a spring-returned rocker type switch to provide nicety of control. The unit G will typically provide a reduction of about 20/1 from its input shaft 20 to its output shaft 22 and the sprockets 23, 26 and 27 may be sized to provide such other gear reduction as may be desired so long as the same reduction is effected from the output shaft 22 to each of the lead-screws. It will be appreciated that the lead-screws 31 and 32 are of the same hand but that their counterparts 28' and 29' are of the opposite hand as will soon be apparent.

FIG. 2 illustrates the construction of each of the leg assemblies. The frame member such as 16 as illustrated extend at each end thereof sustantially to the corresponding end of the table T and is provided at each such end with a bifurcated bracket in the form of two straps 33 and 34 (see also FIG. 4) secured respectively to the outer and to the inner side of the corresponding frame member such as 16 (or 18) and depending therefrom as shown. Each leg assembly includes a guiding brace having an upper portion 36 received at one end between the straps 33 and 34 pivotally joined thereto by a pivot pin 35 defining a pivot axis 35', and a lower bifurcated portion defined between the extensions 37 and 38 of the upper portion 36. The lower ends of the extensions 37 and 38 straddle an intermediate portion of the supporting leg member having a lower portion 43 to which the ends of the extensions are pivotally connected by means of the pivot pin 39 defining the pivot axis 39'. The lower end of the leg portion 43 is received between the bifurcations defined by the uprights 41 and 42 upstanding from the base plate of a foot F and are pivotally connected therebetween by means of the pivot pin 40 defining the pivot axis 40'. The upper end of each leg is provided with the extensions 44 and 44' (see FIG. 6) which are pivotally connected to the depending lug 46 of the nut N of a corresponding lead-screw/nut unit 28, 28', 29 or 29' by means of the pivot pin 45 defining the pivot axis 45'.

As will be detailed in connection with FIGS. 6 and 7, the various nuts N are caused to traverse along the lengths of their respective main and counterpart units either towards or away from each other. The necessary and sufficient condition for achieving the coordinated up and down movements at each of the legs is that the distance between each pair of the pivot axes 35 to 39, between each pair of the axes 39 to 40 and between each pair of the axes 39 to 45 be the same; that all the axes 35 and 45 lie in a common plane parallel to the floor; that the nuts N traverse parallel to this plane; and that the lead-screws of the main and counterpart units 28, 28' and 29, 29' are of opposite hand.

FIGS. 5, 6 and 7 illustrate details of the lead-screw units. Each nut N includes a body portion 53 which is provided with an internally tapped bore receiving its corresponding lead-screw such as the lead-screw 31' illustrated and thereby forming the nut proper which traverses back and forth along its lead-screw as the lead-screw is rotated respectively in its opposite directions of rotation. The lead-screw 32 as illustrated in FIG. 5 projects from one end of the housing 29 and is fitted thereon with the sprocket 27 as well as being coupled with the lead-screw 32' of the unit 29' by the coupling sleeve 50 and associated set screws 51 and 52. The sprocket 26 on the other lead-screw 32 (coupled also to its counterpart 32') is of course axially affset relative to the sprocket 27 by such an amount that the two sprockets 26 and 27 align respectively with respective sprockets of the dual sprocket set 23. As shown in FIG. 5, the projecting ends of the lead-screws are reduced in diameter and are journalled in their respective ends of the housings 29, 29' and 28, 28' as illustrated in that Figure. The opposite end of the lead-screws need not project beyond the ends of the housings but they may, as shown in FIG. 7, where the reduced diameter end portion 31'' passes through the end plate 55 fixed to the end of the housing 28'. Behind this plate is the bearing block member 54 which is recessed to hold the ball bearing BB as shown. The end of the nut N will bottom against the block 54 at one extreme end of travel corresponding to the maximum elevated position of the table T, or the lug may be made to bottom against the end of the slot through which the lug passes. In any event, such a relation limits the upper elevated position of the table. On the other hand, the opposite ends of the housings, such as those illustrated in FIG. 5, likewise provide the maximum squat limit position and these end of the housings in particular should be so located as positively to prevent the motor M or the reduction unit G to engage the floor in the maximum squat position. A block 54 and ball bearing BB is preferably used at each end of each housing to provide the requisite journal support for each end of each lead-screw.

It will be appreciated that other and different structure than as above described may be employed to achieve an equivalent purpose as is intended to be covered by the following claims.

I claim:

1. A horizontally disposed and vertically movable patient support assembly comprising a patient supporting platform, a plurality of separate and independent feet disposed in a predetermined, and fixed wide stance pattern upon a supporting surface, each foot extending a short distance vertically above such supporting surface and each foot having pivot means for pivotally mounting an associated support leg member, a pair of elongate lead screws underlying opposite side portions of the supporting platform and a pair of nut members on each lead screw, means for reversibly rotating the lead screws in unison, a plurality of support leg members, each pivotally attached adjacent its upper end to an associated nut member and extending therefrom into pivotal connection with the respective pivot means of an associated foot, each support leg member having an intermediate pivot means located midway between its pivotal connection to its associated nut member and its pivotal connection to its associated foot, a plurality of brace pivot means underlying the supporting platform in vertically spaced alignment above an associated foot, a brace pivotally connected with a respective brace pivot means and extending therefrom into pivotal connection with an associated intermediate pivot means, the length of each brace between its pivotal connections to its associated brace pivot means and its associated intermediate pivot means being equal to the distance between each pivot means and its associated intermediate pivot means so that the supporting platform is movable vertically, parallel with the supporting surface without moving the feet from the predetermined pattern thereof.

2. A patient support assembly as defined in claim 1 including a horizontal frame underlying the patient supporting platform, the frame comprising a pair of elongate side frame members and a cross member securing the side frame members together and located substantially intermediate the ends of the elongate side frame members, the frame presenting an upper surface upon which the supporting platform is engaged, means securing the platform on the frame, the lead screws underlying the respective side frame members in suspended relation thereto, the drive means underlying the cross member in suspended relation thereto and extending downwardly therefrom by an amount permitting the supporting platform to move between a squatted position near the level of the supporting surface to allow easy access for a patient onto the supporting platform and elevated positions above the supporting surface to present the patient at proper elevation for access by an attendant standing on the supporting surface.

3. A platform support as defined in claim 1 including an H-shaped main frame underlying the platform and forming a mounting means from which said drive means is attached in suspended relation.

4. A platform support as defined in claim 3 wherein said leg means directly supports said main frame.

5. A platform support as defined in claim 4 wherein the upper ends of the leg means are disposed in straddling relation to portions of said main frame.

6. A platform support as defined in claim 5 wherein said drive means includes a reversible electric motor and gear reduction means driven by said motor, both mounted in suspended relation to the crosspiece of said main frame.

7. A platform support as defined in claim 6 wherein said drive means also includes a plurality of lead-screw/nut units mounted beneath said main frame in H-pattern with respect to said crosspiece thereof and driven in unison by said gear reduction means.

8. A platform support as defined in claim 7 wherein the nuts of the lead-screw/nut units are pivotally connected to the upper ends of respective leg means.

9. In a vertically adjustable support for patients, the combination of:

an H-shaped main frame presenting parallel side members and a crosspiece connecting the side members;

a supporting platform disposed in overlying relation to said main frame and attached thereto;

drive means attached to the underside of said main frame so as to underlie the main frame and the supporting platform, said drive means including a first pair of lead-screw/nut units disposed in axially aligned relation below one of said side members to present opposed ends thereof spaced apart on either side of said crosspiece and a second pair of lead-screw/nut units disposed in axially aligned relation below the other of said side members to present opposed ends thereof spaced apart on either side of said crosspiece, first means connecting the lead-screws of the first pair of units and second means connecting the lead-screws of the second pair of units and said first and second means each including a drive sprocket, said drive means also including a reversible drive motor and a reduction unit connected thereto and attached to the underside of said crosspiece, said reduction unit including an output shaft and a dual sprocket assembly on said output shaft, and a pair of endless chain loops trained respectively over the dual sprocket assembly and one of said drive sprockets and over the dual sprocket assembly and the other of said drive sprockets; and a leg assembly associated with each of said lead-screw/nut units in supporting relation to said main frame and each including a leg pivotally attached at its upper end to a nut of a corresponding lead-screw/nut unit.

10. In a vertically adjustable support as defined in claim 9 wherein each leg assembly includes a brace pivotally attached to an associated side member about a pivot axis to swing in a path underlying and parallel to the associated side member, each brace is bifurcated at its lower end to straddle an intermediate portion of an associated leg and pivot pin means pivotally connecting each lower end of a brace with the associated intermediate portion of a leg about an axis parallel to the axis first mentioned, each leg is pivotally connected with an associated foot about an axis parallel with said axis first mentioned, and the lengths of distances between the axes of each leg assembly is the same and the pivot connection between each nut and the upper end of a leg is at the same height as the pivot axis first mentioned so that the platform is vetically movable in coordinated, uniform fashion.

* * * * *